US006647560B1

(12) United States Patent
Hingley et al.

(10) Patent No.: US 6,647,560 B1
(45) Date of Patent: Nov. 18, 2003

(54) COLLAPSIBLE PORTABLE POTTY TRAINER

(76) Inventors: Kimberly Lynn Hingley, 7 Crestmont Rd., Verona, NJ (US) 07044; Robert Hingley, 7 Crestmont Rd., Verona, NJ (US) 07044

( * ) Notice: Subject to any disclaimer, the term of this patent is extended or adjusted under 35 U.S.C. 154(b) by 0 days.

(21) Appl. No.: 10/137,252

(22) Filed: May 2, 2002

(51) Int. Cl.[7] ..... A47K 11/06
(52) U.S. Cl. ..... 4/484; 4/483; 4/451; 297/16.2
(58) Field of Search ..... 4/484, 483, 456, 4/451; 297/16.2

(56) References Cited

U.S. PATENT DOCUMENTS 1,419,947 A * 6/1922 Schoutern ..... 297/17
2,530,474 A * 11/1950 Lutes ..... 4/483
3,124,387 A * 3/1964 MacLaren ..... 297/16.2
3,950,794 A * 4/1976 Dalton ..... 4/484
4,962,551 A * 10/1990 Bly ..... 4/480
5,170,516 A * 12/1992 Davison ..... 4/484
5,564,136 A * 10/1996 Cox ..... 4/480
5,720,513 A * 2/1998 Raukauskas ..... 297/188.1
5,876,091 A * 3/1999 Chernomashentsev ..... 297/16.2
6,116,780 A * 9/2000 Young et al. ..... 383/44
6,247,750 B1 * 6/2001 Tsai ..... 297/16.2
6,341,386 B1 * 1/2002 Phillips et al. ..... 4/484

* cited by examiner

*Primary Examiner*—John Rivell
*Assistant Examiner*—Amanda Flynn

(57) ABSTRACT

Portable potty-chair that readily folds to a compact size, thus providing a toilet trainer that is easily transportable. To attain such a potty-chair, four pairs of pivotally crossed legs, with adjacent legs pivotally attached to connecting bases, form the chair frame. The frame is coupled to the corners of a rectangular seat where the seat has an opening through which waste may pass. In an embodiment, the portable potty chair includes a disposable liner with an elasticized edge to hold the liner in place. In an embodiment, the disposable liner includes a waste receptacle that occupies the seat opening.

9 Claims, 3 Drawing Sheets

COLLAPSIBLE PORTABLE POTTY TRAINER

BACKGROUND OF THE INVENTION

1. Field of the Invention

The present invention relates to a potty chair for use in connection with potty-training children. The potty chair has particular utility in connection with providing a portable device that may be used to facilitate potty training for families on the go.

2. Description of the Related Art

It is well known to provide tot-sized potty chairs to facilitate potty training. However, typical potty chairs can be very bulky and cumbersome, and not readily transportable. Thus portable potty chairs that are foldable to a small size are desirable.

Potty chairs are known in the prior art. Portable toilet seats and wilderness toilets are also known in the prior art. For example, U.S. Pat. No. 5,230,105 to Watson discloses a toilet seat and stand to be used for wilderness camping. However, the Watson '105 patent appears to disclose a toilet seat requiring cumbersome assembly. Although the Watson '105 toilet seat and stand requires little space to carry when unassembled, it would not be suitable for use as a child's potty training device. In the assembled state, the Watson '105 toilet seat provides only two bars to sit and balance upon, which would not be appropriate for a young child still learning to use a toilet. Further, the assembly required for the device disclosed by Watson '105 would prevent the device from being quickly assembled and thus suitable for use as a child's potty training aid. Still further, the device disclosed by Watson '105 provides no means by which to catch or contain toilet wastes.

U.S. Pat. No. 4,3633,536 to Tribble-DuBose appears to disclose a collapsible potty chair with a disposable bag. However Tribble-DuBose '536 discloses a solid seat having legs that are pivotally mounted thereto. Such a seat would not fold to a small size thus allowing the chair to be readily transported and easily carried in, for example, a diaper bag. Consequently, Tribble-DuBose '536 would not be suitable as a highly portable potty chair.

Similarly, U.S. Pat. No. 3,105,655 to Starkweather discloses a folding, portable nursery chair that can be used for toilet training. Like Tribble-DuBose '536, Starkweather '655 would not fold to a size small enough to allow the chair to be easily carried in a diaper bag.

U.S. Pat. No. 4,823,412 to Spiegel discloses a commode chair with pail and seat support. Although Spiegel '412 discloses a suitable adult's commode chair, such a chair would not be suitable as a children's potty training chair as it is too large for use by toddlers. Consequently, Siegel '412 is not suitable as a portable children's potty training chair.

U.S. Pat. No. 6,009,571 to Battiston et al. also discloses a foldable commode. Again, similar to Spiegel '412, Battiston '571 is too large to be considered as a portable children's potty training chair and thus is also not suitable as a portable children's potty training chair.

Lastly, U.S. Pat. No. 2,804,121 to Singleton discloses a child's toilet. Although the child's toilet disclosed by Singleton '121 folds, it would not be suitable for use as a portable children's potty training chair as it would not be highly portable as it includes a rigid waste receptacle that must be emptied and cleaned with each use.

U.S. Des. Pat. No. 355,710 to Hostetler et al. appears to disclose a design for a portable toilet. However, the portable toilet indicated would not be suitable as a portable children's potty training chair.

While the above-described devices fulfill their respective, particular objectives and requirements, the aforementioned patents do not describe a portable children's potty training chair that is easily transportable and that has a compact size allowing the chair to be carried in, for example, a diaper bag. The above-mentioned patents make no provision for easy transportability, easy set up, compact size, and disposable waste receptacle.

Therefore, a need exists for a new and improved portable children's potty training chair that would provide the above-mentioned benefits. In this regard, the present invention substantially fulfills this need. In this respect, the portable children's potty training chair according to the present invention substantially departs from the conventional concepts and designs of the prior art, and in doing so provides an apparatus primarily developed for the purpose of potty training children.

SUMMARY OF THE INVENTION

In view of the foregoing disadvantages inherent in the known types of potty training chairs now present in the prior art, the present invention provides an improved potty training chair, and overcomes the above-mentioned disadvantages and drawbacks of the prior art. As such, the general purpose of the present invention, which will be described subsequently in greater detail, is to provide a new and improved potty training chair which has all the advantages of the prior art mentioned heretofore and many novel features that result in a portable potty training chair which is not anticipated, rendered obvious, suggested, or even implied by the prior art, either alone or in any combination thereof. A folding, portable potty training chair is desirable for use when toilet training children. Such a chair would allow parent to travel, either cross-country or to the neighborhood market, with a child that is not completely toilet trained without the need to resort back to diapers. Such diaper use may be detrimental to the toilet training process. A portable potty training chair is needed that is compact, but that may be set up very quickly. Further, such a chair would provide a hygienic alternative to dirty public rest rooms for toilet-trained children.

To attain this, the present invention essentially comprises a folding potty training chair of the type that folds in both the X and Y directions, which chair is easy to fold and unfold, and which chair has a seat having an opening through which toilet wastes may fall. It is another purpose of the present invention to provide a disposable cover for the folding potty chair, which cover is configured to contain the toilet wastes. It is a further purpose of the present invention to provide an elasticized edge around the outer edges of the cover thus holding the cover over the furthest horizontal extents of the seat while the chair is in use. It is a further purpose of the present invention to provide connectors for use in folding chairs, which connectors provide good support for the chair and are multi-functional in use in the chair.

In accordance with the present invention there is provided a folding portable potty training chair constructed to fold in both the X and Y directions of the chair. The folding potty training chair employs a frame made from pairs of crossed legs, which are pivotally connected together where they cross. The crossed legs form the front, back and sides of the chair and are joined together at the bottom by connecting bases and joined together at the top by seat connectors integral to the flexible seat. The legs are pivotally connected to the connecting bases at the bottom and seat connectors at the top, allowing the legs to move toward a folded position. In a folded position the legs are nearly parallel. A chair thus configured easily folds and easily opens. The bottom connecting bases provide stable footing for the chair when unfolded. The connecting bases are identical in construction, making the chair relatively inexpensive to produce. The seat of the chair is made of flexible material permitting the chair to easily fold and unfold. The seat of the chair has within it an opening arranged such that toilet wastes can fall through the plane of the seat. In an embodiment, an impermeable seat cover is provided, such seat cover having an integrated waste receptacle arranged within the opening in the seat. In an embodiment, a cylindrically shaped carrying bag is provided within which the chair may be transported.

There has thus been outlined, rather broadly, the more important features of the invention in order that the detailed description thereof that follows may be better understood and in order that the present contribution to the art may be better appreciated.

The invention may also include a seat back or arms. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved portable potty training chair that has all of the advantages of the prior art chairs and none of the disadvantages.

It is another object of the present invention to provide a new and improved potty training chair that may be easily and efficiently manufactured and marketed.

An even further object of the present invention is to provide a new and improved potty training chair that has a low cost of manufacture with regard to both materials and labor, and which accordingly is then susceptible of low prices of sale to the consuming public, thereby making such potty training chair economically available to the buying public.

Still another object of the present invention is to provide a new potty training chair that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

Figure 1:
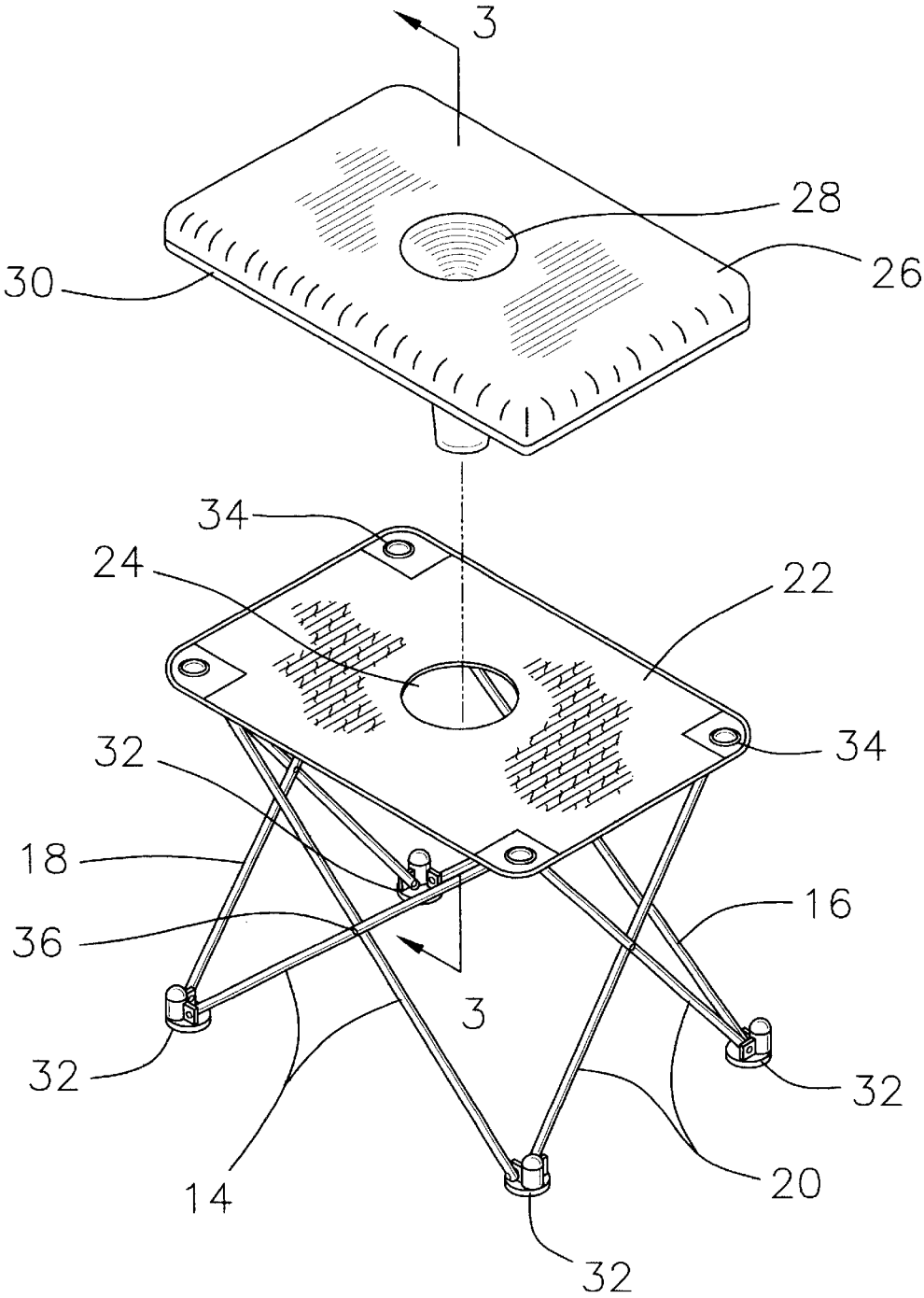
FIG. 1 is an oblique view of the portable potty training chair of the present invention in its normal position of operation. The seat cover used with the portable potty training chair is shown above the chair, in an exploded-type view.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 2:
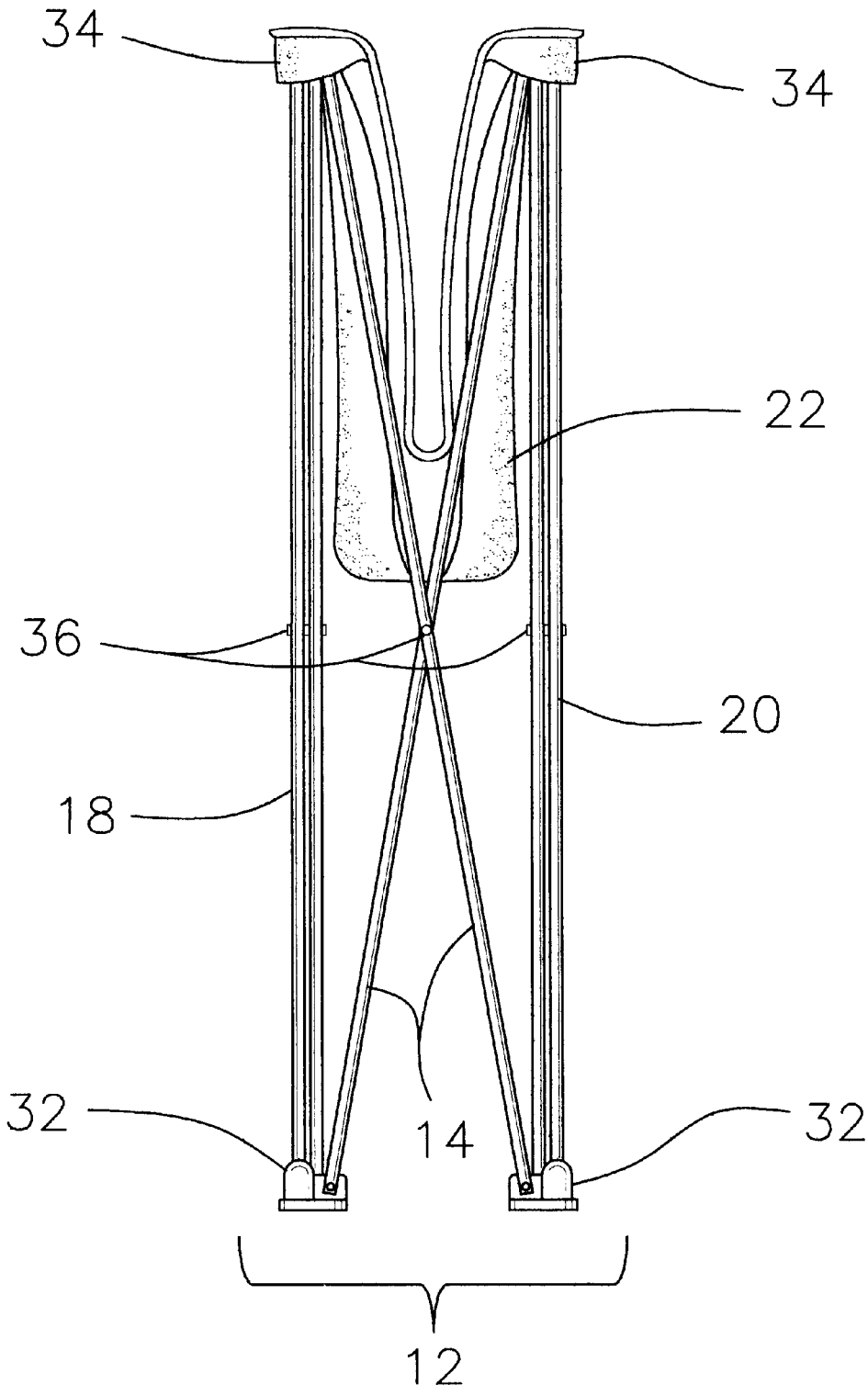
FIG. 2 is a side view of the portable potty training chair of the present invention in the folded position of operation.
Figure 3:
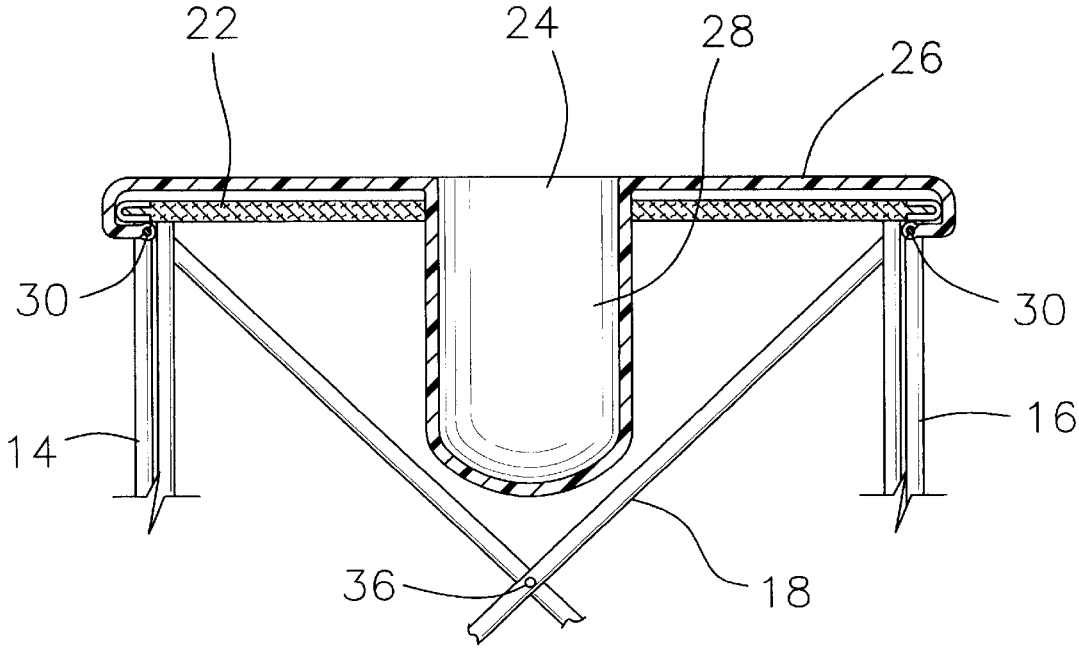
FIG. 3 is a. cross-section view of the portable potty training chair of the present invention. The view is of the chair with the seat cover in use. The cross-section is taken on line 3 of FIG. 1.

Referring now to the drawings, and particularly to FIGS. 1–3, a preferred embodiment of the portable potty trainer of the present invention is shown and generally designated by the reference numeral 10.

In FIG. 1, a new and improved potty chair 10 for toilet training children is illustrated and will be described as follows. The potty chair 10 has a frame 12 made from tubular members or legs. In a preferred embodiment, the frame will be made of a lightweight yet sturdy material such as aluminum. The frame is comprised of; a pair of front crossed legs 14, a pair of back crossed legs 16, and two pairs of side legs; left side legs 18 and right side legs 20. Each pair of crossed legs is pivotally joined together at their approximate centers by a pivot pin 36. The upper and lower ends of the pairs of crossed legs are connected together using connectors. The legs may be quite short to create a chair that is a suitable size for a toddler. For example, the legs may be as short as approximately six inches long. Such a leg length would provide a small, highly portable potty training chair.

FIG. 2 illustrates a side view of the portable potty training chair in the folded position. In the folded position, each leg within a pair of legs is approximately parallel with the other leg within the pair. Further, each pair of legs is approximately parallel to every other pair of legs. Consequently, in the folded position the chair has the approximate shape of a cylinder. Therefore, a cylindrical carrying tote may be provided with the portable potty chair within which to carry the chair.

Returning to FIG. 1, the lower ends of the front legs 14 and the lower, front ends of the side legs are pivotally connected to first and second connecting bases 32. That is, the first connecting base 32 is in the front and connects the lower end of the left front leg 14 to the lower end of front left side leg 18. The second connecting base 32 is also in the front and connects the lower end of the right front leg 14 to the lower end of front right side leg 20.

The lower ends of the back legs 16 and the lower, back ends of the side legs are pivotally connected to third and fourth connecting bases 32. That is, the third connecting base 32 is in the back and connects the lower end of the left back leg 16 to the lower end of back left side leg 18. The fourth connecting base 32 is also in the back and connects the lower end of the right back leg 16 to the lower end of back right side leg 20.

The upper ends of the front legs 14 and the upper, front ends of the side legs are connected to first and second seat connectors 34, which are integral with the seat 22. That is, the first of the seat connectors 34 is fixably coupled to the seat 22 and furthermore connects the upper end of the left front leg 14 to the upper end of front left side leg 18. The second of the seat connectors 34 is fixably coupled to the seat 22 and furthermore connects the upper end of the right front leg 14 to the upper end of front right side leg 20. Likewise, third seat connector 34 couples together seat 22 with the upper end of the right back leg 16 to the upper end of back right side leg 20, and fourth seat connector 34 couples together seat 22 with the upper end of the left back leg 16 to the upper end of back left side leg 18. All the connections between the legs and the connectors are pivot connections. Due to the crossed nature of the legs, note that, for example, a left bottom leg is contiguous with a right top leg. These would both be found along the same leg member.

The four connecting bases 32 are identical and, as shown in FIGS. 1 and 2, each has a pair of perpendicular tabs upon which is mounted a pivot pin. Each pivot pin couples a leg to the connecting base. Each connecting base 32 is shown as having a circular surface with which to contact the floor or ground, however this surface is not necessarily circular. The four seat connectors 34 are also identical. Each seat connector 34 may also have a pair of perpendicular tabs upon which is mounted a pivot pin.

Flexible seat means 22 may be generally rectangular in shape, although it may not necessarily be square. Seat means may be constructed of any suitable flexible material such as, but not limited to, plastic, canvas, leather, or vinyl. The seat connectors 34 are operably coupled to flexible seat means 22. In an embodiment, the seat connectors 34 may be integral with the flexible seat means 22. Seat connectors 34 may be constructed of a synthetic material and heat fused to seat means 22. Alternately, seat connectors 34 may be of a two-piece design, wherein one piece is on either side of the seat means 22 and such pieces held together using a fastening means. Alternately, seat connectors 34 may be of a metal material, and seat connectors 34 may also form a grommet when attached to seat means 22.

Seat means 22 includes an opening 24 through which toilet wastes would fall while the seat is in use. In an alternate embodiment, seat means 22 may incorporate a waste receptacle in lieu of having an opening 24. In such an embodiment, the entire seat means 22 may be removable from the frame and either disposable or machine washable. In the preferred embodiment, seat means 22 is separate and distinct from a seat cover 26 having an integrated waste receptacle 28, as shown in FIG. 1 and FIG. 3.

As shown in FIG. 3, impermeable seat cover 26 has an integrated waste receptacle 28 that fits within the seat means opening 24. Impermeable seat cover 26 may be of a plastic or vinyl material. Alternately, impermeable seat cover 26 may incorporate a highly absorbent material such as any one of those used in diapers or personal hygiene products. Seat cover 26 could include an elastic edge 30 which could be stretched over the edge of the seat. Therefore, the elastic edge 30 of seat cover 26 would be placed below the edges of the seat 22 as shown, thus keeping the seat cover on the seat 22.

In use, it can now be understood that the portable potty training chair described herein would provide a highly portable and compact device that could be used to facilitate potty training when traveling with children. Such a device could be desirable on long car trips or even for short neighborhood trips. Such a portable potty training chair could also provide a hygienic toilet for a small child, thus eliminating the need to use public toilets, which are often dirty. The portable potty training chair would be easy to carry as well as easy to assemble quickly.

While a preferred embodiment of the portable potty training chair has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal, plastic, or a variety of wood may be used instead of the aluminum construction described for the chair frame. Also, the seat means may be of any suitable flexible impermeable material. And although a portable potty training chair has been described, it should be appreciated that the chair herein described is also suitable for a portable toilet for adult use in a variety of applications, for example, camping and hunting.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A chair for toilet training children, comprising:

a frame comprised of a pair of front legs; a pair of back legs; and two pair of side legs, each pair of legs crossed and pivotally connected together where they cross; and a flexible seat means removably connected to the frame, wherein the flexible seat means comprises a waste receptacle, wherein the chair will not support a user when the flexible seat means is removed, and wherein the chair has no seat back.

2. The chair as recited in claim 1, wherein the seat means is adapted to receive a seat cover, wherein the seat cover comprises a waste receptacle.

3. The chair as recited in claim 2, wherein the seat cover further comprises an elasticized edge.

4. The chair as recited in claim 1, wherein the lower ends of the front crossed legs and the lower, front ends of the side crossed legs are pivotally connected to first and second connecting bases.

5. The chair as recited in claim 1, wherein the lower ends of the back crossed legs and the lower, back ends of the side crossed legs are pivotally connected to third and fourth connecting bases.

6. The chair as recited in claim 1, wherein the upper ends of the front crossed legs and the upper, front ends of the side crossed legs are pivotally connected to first and second seat connectors.

7. The chair as recited in claim 6, wherein the seat connectors are integral with the seat means.

8. The chair as recited in claim 1, wherein the upper ends of the back crossed legs and the upper, back ends of the side crossed legs are pivotally connected to third and fourth seat connectors.

9. The chair as recited in claim 1, wherein the flexible seat means is rectangular.

* * * * *